United States Patent [19]

Shaler et al.

[11] 4,041,961

[45] Aug. 16, 1977

[54] HAIR CURLER WITH SINTERED DESICCANT BODY

[76] Inventors: Amos J. Shaler, 705 W. Park Ave., State College, Pa. 16801; Daniel C. McLean, 4029 Alicante, Fort Worth, Tex. 76133

[21] Appl. No.: 656,549

[22] Filed: Feb. 9, 1976

[51] Int. Cl.[2] ..... A45D 2/00

[52] U.S. Cl. ..... 132/40

[58] Field of Search ..... 132/40, 42, 39, 33

[56] References Cited

U.S. PATENT DOCUMENTS

| | | | |
|---|---|---|---|
| 3,175,562 | 3/1965 | Reed | 132/39 |
| 3,316,920 | 5/1967 | Cruise | 132/39 |
| 3,431,917 | 3/1969 | Harris | 132/42 |
| 3,572,350 | 3/1971 | Adams et al. | 132/39 |
| 3,902,508 | 9/1975 | Silman | 132/40 |

*Primary Examiner*—G.E. McNeill

*Attorney, Agent, or Firm*—Reising, Ethington, Barnard, Perry and Brooks

[57] ABSTRACT

A hair treating device is disclosed in the form of a roller or curler and provided with a unitary, porous body of desiccant for adsorbing or desorbing water. The desiccant body is a sintered composite of granules of desiccant, such as silica gel, and a binder comprising particles of a high temperature organic polymeric material, such as nylon. The roller is provided with a heat storage core and with a suitable cover. It is effective to accelerate hair drying and to produce longer lasting curls with improved softness and finish.

9 Claims, 6 Drawing Figures

HAIR CURLER WITH SINTERED DESICCANT BODY

FIELD OF THE INVENTION

This invention relates to hair treating devices of the general type usually referred to as hair rollers or hair curlers. More particularly, the invention relates to such hair treating devices which are adapted to either dry or moisten the hair and simultaneously impart a lasting curl to the hair.

BACKGROUND OF THE INVENTION

Hair treating devices, especially for curling hair, are well known in the form of "rollers" which are typically cylindrical mandrels or bobbins of such size that a hank of hair may be wound thereon for shaping and drying purposes. Such rollers have been fabricated in a wide variety of shapes, sizes and materials and have been widely used for both professional and in-the-home hair treatment. Since the advent of such devices, means have been sought for accelerating the drying of wet hair on the rollers and for obtaining a curl having enhanced characteristics of softness and permanence. The acceleration of drying with hair rollers has been accomplished by apparatus which forces heated air over the roller-supported hair, usually with the aid of an air circulating bonnet. This forced air bonnet apparatus is known to be undesirably confining and uncomfortable for the user. In the professional hair salon the person receiving the hair treatment is usually seated under such a dryer until the desired degree of dryness is achieved. In home treatment, a portable hair dryer is commonly used which requires a connection to the electrical outlet to energize the portable heater and blower and hence the person is confined to a small area of movement.

There has been much effort by others to provide means for accelerating hair drying on rollers without a forced air bonnet to thereby allow the user complete freedom of movement during the drying period. It has been proposed, for example, to incorporate exothermic materials into hair rollers so that wetting of the material produces a reaction which generates heat and accelerates drying of the hair. Such devices are disclosed, for example, in the U.S. Pat. No. 2,074,816 granted Mar. 23, 1937 to Trotter, and U.S. Pat. No. 2,630,809 granted Mar. 10, 1953 to Lewis et al. Exothermic rollers have not gained significant acceptance, presumably because of the difficulty in controlling the temperature of the device.

Another prior art approach to accelerated hair drying is represented by preheated rollers. Such devices usually are provided with a heat retaining member inside the roller and heat is stored in the member prior to use. The heat may be put into the roller by immersing the same into heated liquid or by so-called dry heat from electrical heaters. A preheated roller for simultaneously drying and curling is disclosed in U.S. Pat. No. 3,705,974 granted Dec. 12, 1972 to Nilsson. Such preheated rollers function primarily to drive the water from the hair directly into the surrounding air in the form of water vapor. This process causes drying to proceed at a rate determined largely by the roller temperature and the ambient conditions. Consequently, the results achieved are not consistent from time to time, even with a given user. Preheated rollers, known as "hot rollers", have been used extensively in recent years for setting of dry hair. Such rollers are not intended for drying wet hair. An example of a hot roller is disclosed in U.S. Pat. No. 3,541,302 granted Nov. 17, 1970 to Makino.

The use of desiccant in a hair roller has been proposed for the purpose of accelerating the drying time. It is known, for example, to construct a roller with a tubular body and fill the central passage of the body with a loose granular desiccant. Such an arrangement is shown in the U.S. Pat. No. 3,431,917 granted to M. F. Harris on Mar. 11, 1969. It is also known in the prior art to provide a spool shaped roller body and fill the annular space between the spool flanges with desiccant, as disclosed in the U.S. Pat. No. Re. 27,033 granted Jan. 19, 1971 to H. Mitsumoto. The use of desiccant in powder or particle form poses a problem in containment thereof, and it is believed that this is one reason such devices have not gained commercial acceptance. Certain of the prior art disclosures of desiccant type rollers describe a desiccant body comprised of powder or particles of desiccant which are somehow held together to form a selfsustaining body. This arrangement is disclosed in the U.S. Pat. No. 2,646,053 granted to M. F. Harris on July 21, 1953 and in U.S. Pat. No. 3,175,562 granted to C. F. Reed on Mar. 30, 1965. Also such a structure is alluded to in the above-cited Mitsumoto patent. Molded desiccant bodies, as heretofore proposed, have not gained acceptance, presumably because the prior art techniques for binding desiccant granules resulted in ineffective or inefficient structures for acceleration of the hair drying process.

SUMMARY OF THE INVENTION

The objective of this invention is to provide a hair roller which dries the hair, with or without the aid of forced heated air, in less time than heretofore required and to produce consistently a desirably soft and longer lasting curl of good finish without hair damage, split-ends or "frizz"; the hair roller is to be adapted for use with or without the use of hot forced air and is to be of simple, inexpensive structure which is easy to use, noiseless in operation and adapted to allow the user complete freedom of movement. Further, the roller being adapted for repeated usage without deterioration in usage or performance.

According to this invention, there is provided a hair treating device which comprises a self-sustaining, unitary, porous body comprised of bonded granules of desiccant. When embodied in a roller, the desiccant body constitutes the principal component of the roller and desirably serves as the support structure on which the hair is rolled and as a drying agent for the hair. It has been found that a rigid body of desiccant, properly disposed relative to the wet hair, contributes more to the drying process than the mere adsorption of water. In a preferred form, the desiccant body is a sintered composite comprised of noncompacted desiccant granules bonded together at discrete regions. Preferred materials are silica gel granules bonded by an organic polymer, such as a nylon, the nylon being in the form of particles many times smaller than the silica gel granules. The desiccant body is of unitary character and highly porous; it exhibits good structural properties without impairment of the adsorption properties of the gel and is of lower bulk density than loose desiccant.

The drying and curling of the hair using the sintered desiccant of this invention is greatly improved by imparting heat to the sintered desiccant, preferably at a predetermined or controlled rate. This is accomplished by providing the hair treating device with a heat storage means so that the desiccant operates at an elevated temperature for a given time period. The heat storage means preferably takes the form of a core disposed within a hollow cylinder of sintered desiccant and in engagement therewith, the core being of a material having a high thermal capacity. The core, in one embodiment, is a cylinder of nylon and may define an axial passage adapted to receive a removable member for preheating of the core.

In accordance with this invention, the principal mechanism involved in drying of hair on a roller is that of evaporation and removal of water in vapor form. Accordingly, heat transfer to the hair on the roller plays a governing role and this, in the inventive device, is provided by controlled heat transfer from the core through the sintered desiccant. As indicated above, the wet hair may be wound directly upon the sintered desiccant body. Moreover, the heat transfer property of the sintered desiccant body, as distinguished from the prior art devices, is such that it can be touched and handled without discomfort by the user at the desired preheated elevated temperature. Nevertheless, for reasons of appearance and texture, it may be desired to cover the outer surface of the sintered body.

DETAILED DESCRIPTION

A more complete understanding of this invention may be obtained from the detailed description that follows, taken with the accompanying drawings in which.

Figure 1:
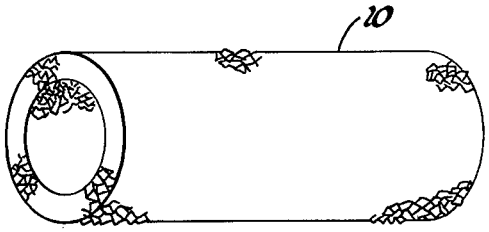
FIG. 1 shows a sintered desiccant body.

Referring now to the drawings, there is shown an illustrative embodiment of the invention in a hair treating device especially adapted for simultaneous rapid drying and curling of hair. As discussed above, the subject invention may be embodied in a device which takes the general form of a hair roller or curler; the principal purpose is to shape a hank of hair to a desired contour, usually a wave or a curl. In effecting this purpose, the hair is usually wet and is to be dried concurrently with the shaping of the hank of hair. As will appear subsequently, however, it is not uncommon to add moisture in some manner from the curlers to hair that is already dry in order to reshape it, and the device of the subject invention may be used for that purpose. Although the subject invention may be used for hair treatment in different ways, it will be described herein primarily with reference to its hair drying capability since this is one of the most vexing problems in the art of hair treatment.

Figure 2:
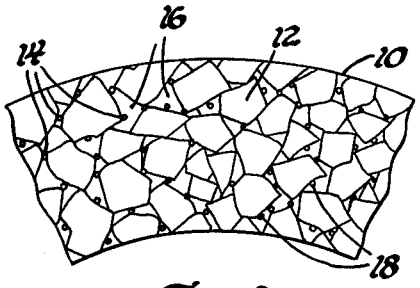
FIG. 2 is an enlarged fragmentary view, partially in section, of the sintered desiccant body.
Figure 3:
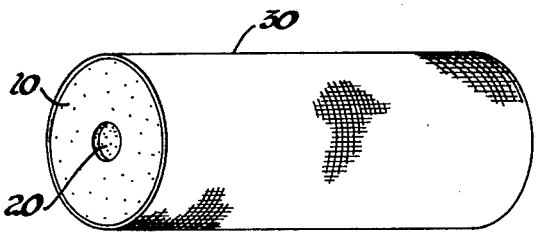
FIG. 3 shows a hair roller in accordance with this invention incorporating the sintered desiccant body.
Figure 4:
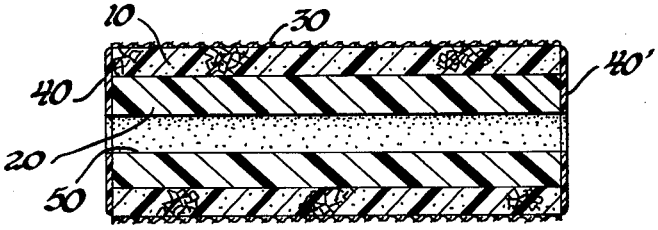
FIG. 4 is a cross-sectional view of the hair roller of FIG. 3.

The hair treating device of this invention is shown in one embodiment in FIGS. 1 through 4. Referring first to FIGS. 3 and 4, the device, in the form of a hair roller, will be described in general terms. The hair roller comprises a sintered desiccant body 10 of hollow cylindrical shape. The roller is provided with a heat storage core 20 of cylindrical shape and a cover 30 of thin sheet-like construction. The core 20 defines a bore 50 which is adapted to receive a heating element or pin for imparting heat to the core 20. A more detailed description of the roller follows.

The desiccant body of this invention, adapted for use in a hair roller, is shown in FIGS. 1 and 2. The desiccant body, for this purpose, is in the form of a hollow cylinder and is entirely self-sustaining. A preferred process for making the desiccant body will be described in detail below; at this point, the structural aspects of the body will be described in detail with only general reference to the process of making the body. The structural description will be given with reference to the desiccant body illustrated for use in a hair roller.

The desiccant body is a sintered composite body which comprises a mixture of granules of desiccant and particles of binder. The entire hollow cylinder 10 of FIG. 1 is constructed of the sintered composite materials and an enlarged fragmentary view of the internal structure is shown in FIG. 2. The body comprises a mass of granules 12 of a desiccant, such as silica gel, and the granules are held together by particles 14 of binder, such as a nylon, between contiguous granules of desiccant. Each granule 12 is of irregular shape and the granules are assembled to form the desired overall hollow cylindrical shape by means of a retaining form or mold. The granules are preferably assembled loosely, i.e. the only compaction force being the weight of the granules, so that the granules form an array with discrete points of engagement between contiguous granules. This leaves voids or interstices 16 separating the granules throughout the array. Such interstices open into each other so that there is communication between adjacent interstices and communication between any two interstices in the body. Each of the particles 14 of the binder is attached to discrete surface areas of contiguous granules with the particles 14 bridging between the granules. There are also particles 18 which are disposed on the surface of the granules and attached to one granule only. Such particles 18 serve no useful purpose but occur in the body 10 as a result of the preferred method of making the body, as will be understood from the detailed process description given hereinafter.

In the preferred embodiment of the sintered body, the desiccant granules are silica gel and the binder is a nylon powder. Other desiccants including activated alumina and bauxite are also suitable; other thermoplastic binders, also of organic polymeric material which may be used in powder or particulate form are those like polycarbonate and polyvinylchloride that have a melting point above approximately 260° F. The desiccant is comprised of granules substantially all of which are in the size range from 8 to 60 mesh, Tyler. A preferred granule size for a given body in a hair roller is comprised of granules in the size range from 12 mesh to 28 mesh. The binder powder of organic polymeric material is preferably of a particle size of 200 mesh or smaller. In the preferred embodiment the aforementioned size ranges for desiccant granules and binder particles results in a typical desiccant granule having a diametral dimension on the order of 1000 microns whereas a typical binder particle would have a diametral dimension on the order of 100 microns. A preferred silica gel is Davison silica gel grade 408 available from the Davison Chemical Division of W. R. Grace Company of Baltimore, Md.; a preferred nylon powder is Nylon 11 which is available from E. I. Dupont De Nemours of Wilmington, Del. The preferred sinter formulation is that which provides complete bonding of the desiccant granules with the smallest amount of binder so that the maximum sinter porosity and lowest bulk density are attained. With the Davison silica gel grade 408 and the Nylon 11 the preferred ratio of ingredients is 5 parts by weight of gel to 1 part by weight of nylon powder. Preferably, a quantity of water, from three to ten percent by weight, is added to the mixture to aid distribution of the binder particles during forming of the body. The formulation may be varied somewhat with particle size and specific gravity of the desiccant.

Desiccant body 10, for use in a hair roller, may be fabricated in a wide range of sizes. For example, the length of a roller may range from 1½ inches to 3½ inches with an outside diameter ranging from ½ inch up to 4 inches. The wall of the cylindrical desiccant body should be at least 3/16 inch thick to obtain best performance in a hair roller, regardless of the other dimensions of the desiccant body. Wall thicknesses greater than 3/16 inch do not adversely affect performance of the desiccant body in a hair roller.

As stated above, the hair roller also comprises a heat storage core 20. The function of the core 20 is to accept heat from an external source and to transfer such heat to the sintered desiccant body at a predetermined rate. The core 20 is preferably constructed of a nylon, such as Nylon 11, and thus has a high specific heat and a relatively low specific gravity. This provides the maximum heat retention properties with the smallest weight. The core 20 is provided with the bore 50 so that the roller may be heated in a known manner by placing the roller over a heating element (not shown) in the form of a pin which fits within the bore. The core 20 is suitably cylindrical in external configuration and it forms an interface with the inner surface of the desiccant body 10. At the interface the desiccant body and the core are in intimate engagement with each other and are bonded by the binder particles 14 and 18 which are disposed at the interface. This intimate engagement provides heat transfer from the core to the desiccant body. The core may be made of other materials, including other thermoplastics such as polycarbonate. It should, however, have a specific heat in the range of about 0.5 to 0.6 calories per gram. It should also have a softening point in excess of 300° F so that it can withstand the temperature of the pre-heating and regeneration operation, as described later, and the temperature of the heating element.

Although the cover 30 is not necessary from a functional standpoint, it is desirable for the sake of appearance and texture. The cover 30 comprises a sheet-like material of woven fabric and is stretched over the surface of the sintered desiccant body. The cover 30 is suitably made from a rectangular sheet wrapped around the body and the edges are joined at a seam by an adhesive. If desired, the ends of the sintered body may be coated to provide a smooth surface. A suitable coating material is an epoxy resin, colored if desired by pigment in the resin.

PERFORMANCE AND USE OF HAIR ROLLER WITH SINTERED DESICCANT BODY

In the use of the hair roller just described, the roller is preheated and regenerated, prior to each application to the hair. The roller, along with others of various sizes in a set of such rollers, may be heated in a conventional heater for hair rollers. Such apparatus is preferably of the type which is provided with heating pins adapted to mate with the bores of the rollers, and is preferably of the type which is also provided with rigorous flow of air among the rollers, although a conventional oven heater may also be used. The rollers are heated to a temperature above the boiling point of water, such as about 260° F. At this temperature, the desiccant body is quickly and completely regenerated, i.e. the adsorbed water is driven off so that practically no water remains in the desiccant. Also, the temperature of the core 20 is increased to the same temperature and thus serves to store heat for use in the treatment of the hair. Heating and regeneration of the rollers to the desired temperature may require a period of time ranging from 5 minutes to 45 minutes depending upon the heating capacity and efficiency of the apparatus used and the amount of water previously adsorbed. After the desired temperature has been achieved, the heated roller is ready for application to the hair.

As soon as heating of the roller is terminated a very high temperature gradient will develop across the radial dimension of the desiccant body near its outer surface. This obtains because the desiccant body is a poor thermal conductor due to the low density of the granules and the low bulk density of the body coupled with the fact that it has a discontinuous or porous surface. Within a fraction of a minute after heating is terminated the roller can be handled by bare fingers without discomfort even though all but the surface is at a temperature in excess of the boiling point of water. The sintered body thus acts as an insulator and impedes heat transfer from the core so that heat flow therefrom is regulated. Typically, the roller will be applied to wet hair of the user where the desired treatment is drying and curling of the hair. When the roller is first applied to the hair water vapor will be produced at a rapid rate. The region immediately surrounding the roller and the tress of hair thereon is permeated by the water vapor generated from the wet hair by the heat released from the roller. This water vapor is preferentially taken up by the desiccant and is also dispersed into the surrounding atmosphere at a rate dependent upon air movement, temperature and humidity.

The water vapor taken up by the desiccant body is, to a large extent, independent of the conditions of the surrounding atmosphere and is dependent primarily upon the available surface area of the desiccant material and the temperature of the desiccant material and the moisture content thereof. Stated otherwise, the desiccant will adsorb water vapor provided that the ratio of partial pressure of the vapor in the air to the saturation value (i.e. the relative humidity) is greater than the same ratio (i.e. the fugacity) in the desiccant. The rate of adsorption increases with the difference between relative humidity of the air and fugacity of water in the desiccant. Both of these decrease with temperature but the relative humidity decreases faster with increasing temperature than does the fugacity of water in the desiccant. Accordingly, the desiccant body of the roller is conditioned to take on a large quantity of water vapor at a relatively high rate by reason of the initial high temperature and low water content thereof and the initial high water content of the air surrounding the hair. The temperature of the desiccant body is maintained at an elevated level by the transfer of heat from the heat storage core 20 over a period of about one hour. At a later time, the hair having become drier and the core and desiccant being cooler, the rate of adsorbtion of water vapor by the desiccant decreases and eventually becomes negative, vapor then passing out of the desiccant, through the air spaces between the hair and out to the atmosphere, or through the cap to the atmosphere. Since the granules of desiccant are separated by interstitial spaces which open into each other, the water vapor is allowed to reach granules throughout the desiccant body. The granules in the region near the core remain very hot for a period up to thirty minutes and initially exhibit a slightly lower capacity for taking up water vapor whereas those near the outer surface, being initially cooler, do the bulk of the adsorbing. Hence, the upper limit of the useful thickness of the desiccant body. It is noted that the heat of adsorption which is incident to the adsorption process is negligible in comparison with the quantity of heat supplied by the heat storage core.

As to the available surface area of the desiccant, the structural array of the granules 12 of desiccant, as described above with reference to FIG. 2, is of great significance. The available surface area comprises the external surface area and the very much greater internal surface area of the pores therein. Individual granules 12 have only a very small percentage of their external surface area covered by particles 14 and 18 of the binder. It has been found that adequate binding is achieved by a ratio of 5 to 1 by weight of desiccant to binder; this ratio of weights results in covering of less than two percent of the surface area of the desiccant. (A small surface coverage is partially due to the use of a binder which does not wet the desiccant and to the use of a sintering temperature lower than the melting point but higher than the softening point of the binder. A sintering temperature of 460° F is preferred with Nylon 11 which has a softening point of 284° F and a melting point of 482° F.) Further, since the granules 12 of desiccant are attached by the binder particles at discrete points, the interstitial spaces 16 open into each other and allow water vapor to reach granules located anywhere in the array, and in particular in the region near the core, where the desiccant granules remain for periods of up to 30 minutes at a temperature in excess of the boiling point of water, even though the surface granules are at a substantially lower temperature throughout the drying period.

The roller embodying the sintered desiccant body is capable of consistent performance over many hundreds of cycles of use. The sintered desiccant body retains the granules in fixed relative positions and hence there is no abrasion among the granules with resultant "dusting" as in the case of loose desiccant granules. Consequently, there is no problem of containment and no loss of available desiccant surface area. The desiccant does not deteriorate physically or chemically as a result of temperature cycling and is insoluble in water and in typical hair sprays and rinses. Additionally, it is nondeliquescent, chemically inert and nontoxic.

The hair roller, as described above, is effective to accelerate drying of the hair, with or without the aid of forced heated air or other auxiliary devices. The treatment of the hair as described imparts a soft and long lasting curl to the hair.

The hair roller embodying the solid desiccant body, in addition to its use for drying and curling the hair, is also useful for treating dry hair where it is desired to merely set the hair without previous washing or wetting. For this purpose, the roller is heated to the desired temperature, such as 260° F, and fine water droplets are dispersed onto its surface, so that the desiccant adsorbs a predetermined quantity of water vapor; the surface of the roller is thereby cooled to the boiling point of water, but only to a limited depth. The roller is then placed on the dry hair and kept in place for a period of time, such as 20 to 40 minutes, during which the hair, being hygroscopic in character, will, at first, rapidly take on water vapor from the desiccant, and then behave as if it had been previously washed or wetted. This moisturizing of the hair, coupled with the elevated temperature, will cause the hair to take a set. Thus when the roller is removed a soft and long-lasting curl will be imparted to the hair.

EXTERNAL CURLER WITH DESICCANT SINTERED BODY

Figure 5:
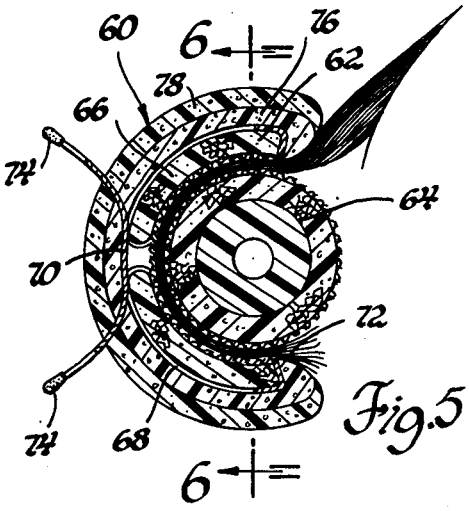
FIG. 5 is a cross-sectional view of an external curler embodying this invention and disposed over a roller with a hank of hair therebetween.
Figure 6:
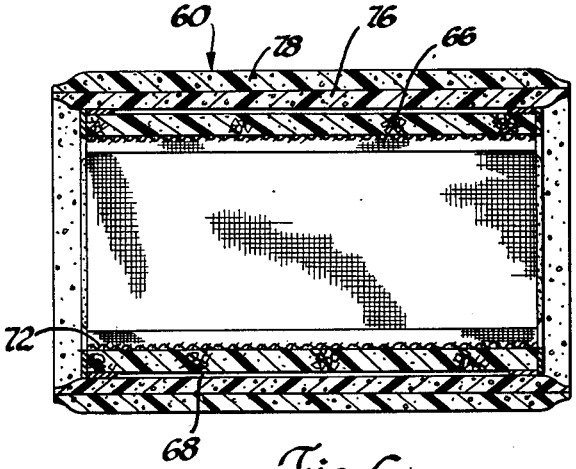
FIG. 6 is a view taken on lines 6—6 of FIG. 5.

Another embodiment of the hair treating device of this invention is shown in FIGS. 5 and 6. In this embodiment, a sintered desiccant body is provided in an external curler. As shown, the external curler 60 is of semi-cylindrical configuration and is adapted to be clamped, or otherwise held over a hank of hair 62 wound on a roller 64. The curler comprises a sintered desiccant body 66 and a sintered desiccant body 68 which are arcuate in cross-section and have an axial length approximately the same as the roller. The sintered desiccant bodies 66 and 68 are of the same internal structure and composition as the sintered desiccant body described with reference to the embodiment of FIGS. 1 through 4. The arcuate sintered bodies 60 and 68 are self-sustaining and constitute a rigid structure. In order to allow for opening of the curler, i.e. enlargement of the open portion thereof, so that it can be disposed over the hank of hair on the roller, the sintered desiccant bodies 66 and 68 are hingedly connected with each other. This is provided by means of a support frame 70 which is constructed of spring sheet metal of semi-cylindrical shape. The sintered desiccant bodies 66 and 68 are supported internally of the frame 70 and held in place by an adhesive. The frame also is provided with handles 74 which are suitably formed by a struck-out portion of the frame and bent outwardly therefrom in opposed relation to each other. The frame 70 engages the sintered desiccant bodies 66 and 68 only at the peripheral portions thereof, in the manner of a window frame, so that only small surface areas of the bodies are covered by the frame. The sintered desiccant bodies 66 and 68 are thus hingedly mounted relative to each other by the flexible spring frame. The external curler 60 may be opened by pressing the handles 74 toward each other and is reclosed upon release of the handles and return of the spring to its unflexed position for clamping the curler over the roller. The inner surface, or if desired, the entire surface area of the sintered desiccant bodies 66 and 68 may be covered with a suitable sheet-like material (not shown) as described above in connection with the embodiment of FIGS. 1 through 4.

The external curler may be provided with an outer covering or curler cap. Such a covering includes a double layer, open-cell foam. This includes an inner layer 76, preferably a hydrophobic polyester open-cell foam and an outer layer 78, preferably a hydrophilic polyester open-cell foam. The foam layers 76 and 78 are formed with closed ends and are secured to each other, as by adhesive or heat bonding, around the peripheral edges thereof. The foam layers are secured to the frame 70 by an adhesive.

The performance and use of the external curler embodying the inventive sintered desiccant body is the same as that described with respect to the roller of FIGS. 1 through 4 and will not be repeated here.

PROCESS OF MAKING A SINTERED DESICCANT BODY

In making the sintered desiccant body, the body is formed to the desired configuration in a split, hollow, cylindrical mold without compaction of the mix except that exerted by its own weight. The mold is preferably made of polytetraflouroethylene, since this material provides good release of the molded part, and, of course, readily withstands the sintering temperatures. The mold may, however, be made of metal and provided with a suitably treated surface, such as a spray coating of a fluorinated polyethylene.

Dry silica gel, such as Davison Chemical grade 408, is prepared by adding water, preferably by steaming, in an amount equal to 3% to 10% of the dry gel. Nylon 11 powder, equal to one fifth the weight of the dry silica gel, is added to the moistened silica gel and agitated by a shaker until the mix is substantially homogeneous. If the sintered desiccant body is to be used with a core, such as the nylon core of the embodiment of FIGS. 1 through 4, the core is positioned initially in the mold. The prepared mixture of desiccant and binder is then poured into the mold and the mold is filled without tamping or shaking.

To sinter the mixture, the mold is placed into an oven which has been preheated to about 460° F. The sintering time is approximately one-half hour. The proper degree of curing is indicated by the tackiness; in addition the mixture will feel soft to a probe. The mold is removed and allowed to cool at room temperature. When the mix feels hard to a probe the sintered body can be removed from the mold. A properly sintered and cured body exhibits a somewhat rough but not crumbly surface.

Although the description of this invention has been given with reference to particular embodiments thereof, it is not to be construed in a limiting sense. Many variations and modifications will now occur to those skilled in the art. For a definition of the invention reference is made to the appended claims.

The embodiments of the present invention in which an exclusive property or privilege is claimed are defined as follows:

1. A hair treating device adapted to receive a hank of hair, said device including a porous body comprised of an array of granules of desiccant and particles of an organic polymeric binder attached to said granules with certain of said particles bridging between contiguous granules and bonding therebetween at discrete regions throughout the body to form a self-sustaining body, said particles of binder having a smaller size than the desiccant granules, said granules defining interstices which open into each other between said bonded regions for admission of water vapor to the surface of granules in the interior of said porous body, and a cover disposed over the exterior of said porous body, said cover being permeable to water vapor.

2. The invention as defined in claim 1 wherein said body is a hollow cylinder.

3. The invention as defined in claim 1 wherein said desiccant is a silica gel and said polymeric material is a nylon.

4. The invention as defined in claim 1 wherein said body is plate-like, and means for attaching said body to a hair roller supporting a hank of hair, with said body partially surrounding said hank of hair.

5. The invention as defined in claim 2 wherein the wall of said hollow cylinder has a thickness of at least 3/16 inch.

6. The invention as defined in claim 3 wherein the silica gel granules are in the size range of 8 to 60 mesh and the bonding regions are formed of a nylon powder having a particle size less than 200 mesh.

7. The invention as defined in claim 2 wherein said cylindrical array is a hollow cylinder, a core being disposed within said hollow cylinder and in engagement with the inner wall of said body.

8. The invention as defined in claim 7 wherein said core is a cylindrical body of a nylon.

9. The invention as defined in claim 8 wherein said cylindrical body of a nylon defines an axially extending passage adapted to receive a removable heater element.

* * * * *